US005199670A

United States Patent [19]

Cheltenham

[11] Patent Number: 5,199,670

[45] Date of Patent: Apr. 6, 1993

[54] HELICOPTER STUNT KITE

[76] Inventor: Eugene Cheltenham, 1823 Hollyvista Ave., Los Angeles, Calif. 90027

[21] Appl. No.: 699,330

[22] Filed: May 13, 1991

[51] Int. Cl.[5] ..... A63H 27/08; B64C 31/06

[52] U.S. Cl. ..... 244/154

[58] Field of Search ..... 244/153 R, 154, 155 R, 244/155 A; 446/34

[56] References Cited

U.S. PATENT DOCUMENTS

| | | | |
|---|---|---|---|
| 2,429,502 | 10/1947 | Young | 244/154 |
| 2,442,846 | 6/1948 | Dunn | 244/153 |
| 2,453,857 | 11/1948 | Platt et al. | 244/154 X |
| 2,472,290 | 6/1949 | Fernstrum | 244/154 |
| 2,493,704 | 1/1950 | Tomczyk et al. | 244/154 |
| 2,537,393 | 1/1951 | Bisch et al. . | |
| 2,781,989 | 2/1957 | Hagood et al. | 244/154 |
| 2,893,663 | 7/1959 | Wilson | 244/154 |
| 3,022,967 | 2/1962 | Romeo | 244/154 |
| 3,079,116 | 2/1963 | Trimble | 244/154 |
| 3,194,521 | 7/1965 | Rider et al. | 244/154 |
| 3,305,197 | 2/1967 | Daggett | 244/153 R |
| 3,727,864 | 4/1973 | Tolomizenko | 244/154 |
| 3,770,229 | 11/1973 | Seefluth | 244/154 |
| 4,158,448 | 6/1979 | Mochizuki | 244/13 |
| 4,216,929 | 8/1980 | Holland, Jr. | 244/153 R |

*Primary Examiner*—Mickey Yu
*Attorney, Agent, or Firm*—William W. Haefliger

[57] ABSTRACT

A toy aircraft structure, including a forwardly elongated fuselage, including left and right elongated sections, and structure holding the sections in assembled relation; the structure having a retainer portion projecting upwardly and above the sections; and a forwardly and rearwardly elongated kite extending above the fuselage and attached to the retainer portion.

12 Claims, 4 Drawing Sheets

27c
22
39b
5
27
~28~
39
34
35b
11
18"
26
27a
30
100
35a
9
9
7
7

39b
6
39
27
6

8
8
101
28
27a
100

39
27
39b 100
101
27a

FIG. 4.
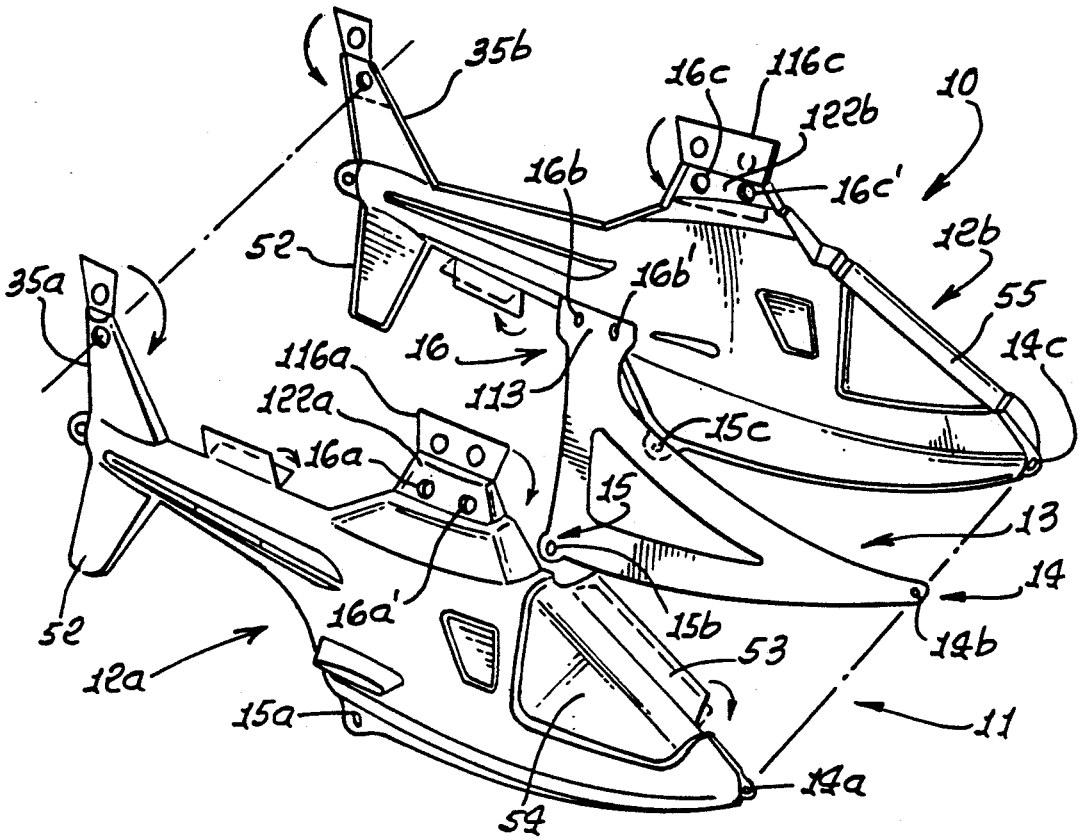
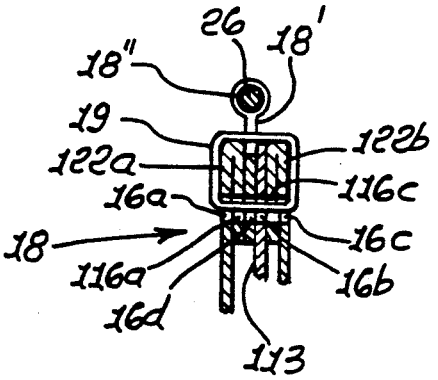
FIG. 10.
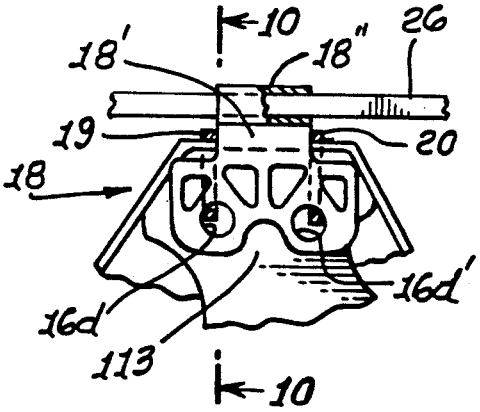
FIG. 9.

HELICOPTER STUNT KITE

BACKGROUND OF THE INVENTION

This invention relates generally to toy aircraft, and more particularly, to an aircraft-kite combination toy of unusually advantageous construction and modes of operation and control.

There is a constant market need for flyable toy aircraft, and especially for kite-type, flyable toys capable of performing stunts in the air, while under control of a single flying line. To my knowledge, no prior toy aircraft has provided or embodied the unusually advantageous combinations of construction, modes of operation, and results no provided by the present kite-type toy aircraft, which may have the appearance of a helicopter.

SUMMARY OF THE INVENTION

It is a major object of the invention to provide a kite-type toy aircraft meeting the above needs. Basically, the aircraft includes:

a) structure, including a forwardly elongated fuselage, including left and right elongated sections, and means holding the sections in assembled relation, b) the structure having a retainer portion projecting upwardly and above the sections, c) and a forwardly and rearwardly elongated kite extending above the fuselage and attached to the retainer portion.

As will be seen, the kite may extend generally horizontally relative to the fuselage, above the retainer portion and the fuselage; and the kite retainer portion is typically located about or generally midway along the elongated length of the fuselage. A kite attachment may be provided between the retainer portion and the kite, the attachment defining a forwardly elongated pivot axis allowing the kite to pivot about that axis relative to the fuselage; and that attachment may advantageously include forward and rearward transverse openings through the retainer portion, and locking strips or other locking devices extending through the openings and attached to a first spar defined by the kite.

A further object is to provide a flyable toy capable of controllable take-offs, loops, dives, hoverings and landings. Using a simple kite sail for lift eliminates need for complex, moving rotor blades and resulting aerodynamic problems and engineering associated with spinning rotor blades as well as problems of sustained flight. The invention enables use of realistic helicopter body or fuselage and a kite sail with printed rotor blades giving the toy an appearance of a flying helicopter.

Another object includes the provision of a second spar which is U-shaped forwardly of the first spar, and which includes legs that extend rearwardly at left and right lateral sides of the first spar. The legs are typically cantilever flexible, upwardly and rearwardly to provide kite dihedral, progressively rearwardly, and relative to the fuselage, for stability.

A further object is to provide an upright reinforcement panel which extends forwardly and rearwardly, between the sections, the sections having left and right complementary shell configuration and the panel retained therebetween. The fuselage has a nose portion and a bridle line is attached to the forward extent of the kite, extending downwardly through a loop at the fuselage nose portion, and then to a rearward underside connection to the fuselage, or panel; further, a clip ring is retained on the bridle line for attachment to a tether controlled by the user.

Yet another object is the provision of a forwardly and rearwardly elongated center spar having first pivotal attachment to the retainer portion above a mid-portion of the fuselage, and also having second pivotal attachment to a rearward portion of the fuselage and a third pivotal attachment at the front of the kite, allowing attachment to the fuselage with a section of the bridle line. Purposes of the three attachments are to keep the fuselage in constant alignment with the kite sail; to distribute bridle line loading over three attachment points; and to prevent pitch and yaw of the kite sail, which would risk loss of control leading to spins and too rapid descent.

An additional object is the provision of fuselage shell sections which have forward portions, and including a flexible band adhesively attached to the forward portions allowing clam-shell pivoting of the sections into spread-apart relation upon impact of the fuselage with the ground at the end of flight. Those forward portions may together define a wind shield.

These and other objects and advantages of the invention, as well as the details of an illustrative embodiment, will be more fully understood from the following specification and drawings, in which:

DRAWING DESCRIPTION

FIG. 4 is an exploded perspective view of the FIG. 1 kite fuselage;

FIG. 9 is an enlarged view taken on lines 9—9 of FIG. 3 showing a central fitting;

FIG. 10 is an enlarged section taken on lines 10—10 of FIG. 9;

DETAILED DESCRIPTION

Figure 14:
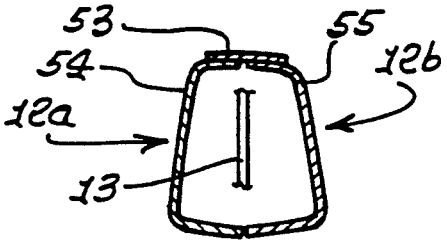
FIG. 14 is a section taken transversely through the fuselage.
Figure 15:
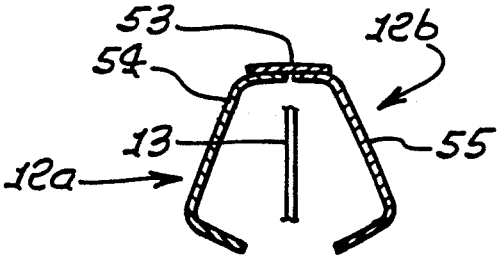
FIG. 15 is a view like FIG. 14 showing spread-pivoting of the fuselage sections.
Figure 13:
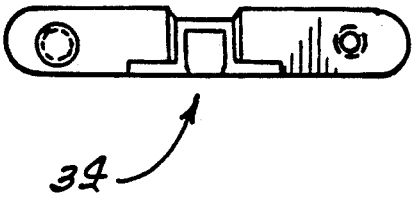
FIG. 13 is a view taken on lines 13—13 of FIG. 12.

In FIGS. 1, 2, 4, 14, and 15, the toy aircraft 10 comprises structure 11, including a forwardly elongated fuselage 12, having left and right elongated sections 12*a* and 12*b*. These are shown in FIGS. 4, 14, and 15 as molded, thin-walled, complementary plastic shells which may have helicopter shape when assembled together, as in FIGS. 1 and 2. Means is also provided to support and hold the shells in assembled state. As shown, such means comprises a thin, flat, plastic reinforcement stiffener and support or armature panel 13 located between the shells in FIG. 4 and being forwardly elongated. It may have delta shape as seen, with three-point attachment to the shells, as at locations 14–16, the attachments including matching holes 14a, 14b and 14c at the nose, 15a, 15b and 15c at the exterior underside of the fuselage, and at 16a, 16b and 16c, and also 16a', 16b' and 16c' at the exterior top side of the fuselage. See also fold down tabs 116a and 116c with corresponding holes. Retainers, such as plastic strips or strings in the form of ties or plastic locking strips or other locking devices, may be easily applied by passing the ties through the matching holes and tying them. Such retainers will be referred to later.

The structure includes a kite retainer portion 18 projecting above and upwardly of the fuselage sections, and generally midway along the length of the fuselage. Such a retainer may be provided by upper complementary half-shell extents 122a and 122b of the fuselage sections; and by the flat upper extent 113 of the panel 13. These retainer elements are in lateral registration, and held together by the plastic strip ties 19 and 20 seen in FIG. 2, and passing through the lateral holes 16a, 16b, and 16c, and 16a', 16b', and 16c'. The kite retainer portion 18 retains a kite 22 above the fuselage and attached thereto. The kite is shown as forwardly and rearwardly elongated, and also extends broadly laterally, in a generally horizontal plane (relative to the fuselage); however, the spar configuration of the kite and its pivoted attachment to the fuselage allows upward flex-bowing of the kite lateral extents (in a dihedral relation for, stability).

The kite includes a first spar 26 which extends longitudinally forwardly, and a second spar 27 which has a U-shaped forward extent 27a, and rearwardly extending legs 27b and 27c at left and right lateral sides of the first spar, and spaced therefrom. Thin sheet material 28, as for example plastic material, is attached to the second spar 27 to provide lifting surface presented to the wind. A pivot loop 18'' pivotally extends about the spar 26 and has a web 18' attached by ties 19 and 20 to 122a and 122b. See FIG. 10. Web 18' forms openings 16d and 16d' in registration with 16a—16c, and 16a'—16c', respectively.

It will be noted that the kite is pivotally attached to the fuselage to allow relative pivoting about a longitudinal control axis 30 close to the first spar. That axis may be defined by the pivot attachments of the loose ties 19 and 20 to the retainer portion 18, at the forward and rearward openings 16a, 16b and 16c, and 16a', 16b', and 16c' referred to. For stability, the rearward extent of central or first spar 26 may be loosely pivot attached at 34 to a fin 35 on the fuselage rearward extent. That fin may have complementary shell sections 35a and 35b, as seen in FIG. 4, and the yoke attachment at 34 allows relative pivoting about axis 30. Also, the fuselage sections are held together at 34.

Figure 1:
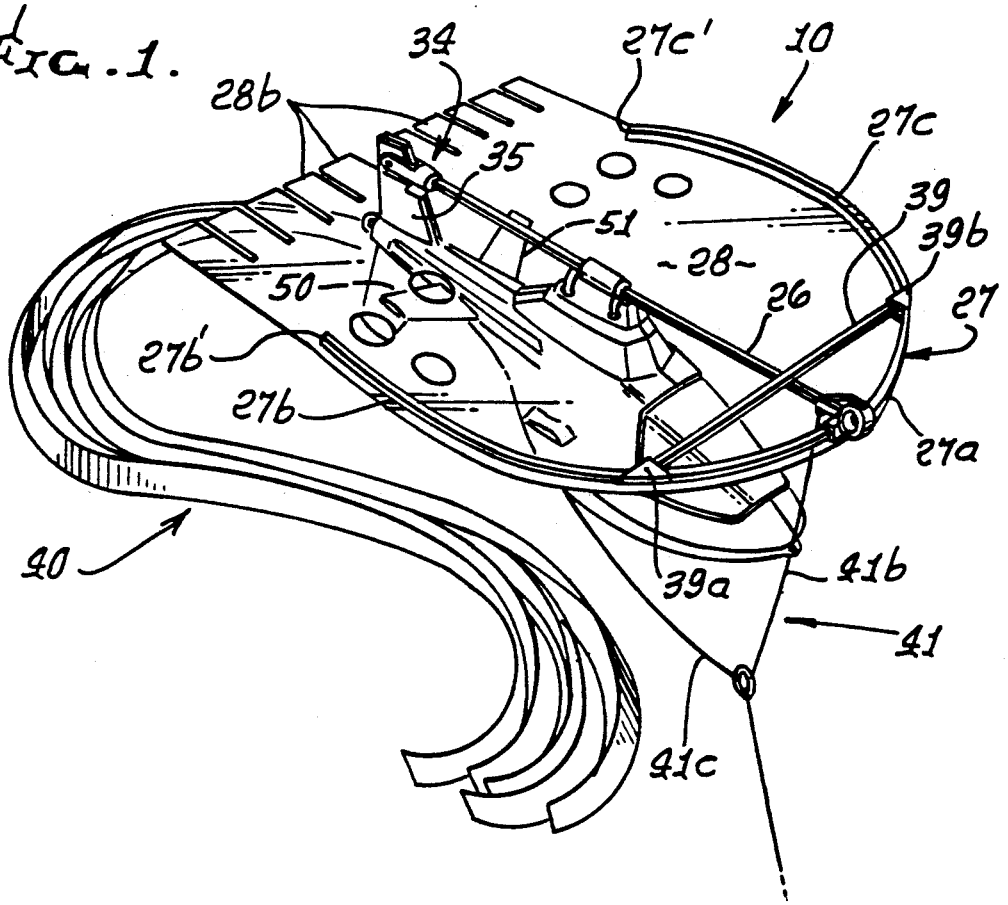
FIG. 1 is a perspective view of a toy kite embodying the invention.

The free terminals 27b' and 27c' of the second spar legs 27b and 27c allow upward cantilever bowing of those legs relative to the U-shape nose section 27a of spar 27, to provide rearwardly increasing dihedral of the kite lift surface 28 for enhanced stability in flight. A series of flaps 28b may be provided at the rearwardmost extent of the kite surface material 28, as seen in FIG. 1, and flexible trailing stringers 40 may be attached to the rear of the fuselage to provide further stability. A third and lateral spar 39 may extend as shown in FIG. 1, with attachment at 39a and 39b to legs 27a and 27b at or near their forwardmost extents.

A bridle line 41 has one end thereof 41a attached to the kite, as at loop 43. The line 41 then extends downwardly through and is attached to a loop at location 14, and as provided by fuselage loop portions 14a and 14c, as well as by panel 13 forward loop portion 14b, these loop portions being in registration. The bridle line then hangs downwardly at 41b and rises rearwardly at 41c to attach to the fuselage at location 15 referred to above. At location 15 the bridle line passes through loop portions 15a and 15c on the fuselage, and through loop portion 15b formed by panel 13. A retainer ring 45 is slidable on the bridle line, and a tether 46 may attach to the ring and extend to the ground, for kite flying by the user. That ring slides back and forth as the aircraft maneuvers.

Figure 2:
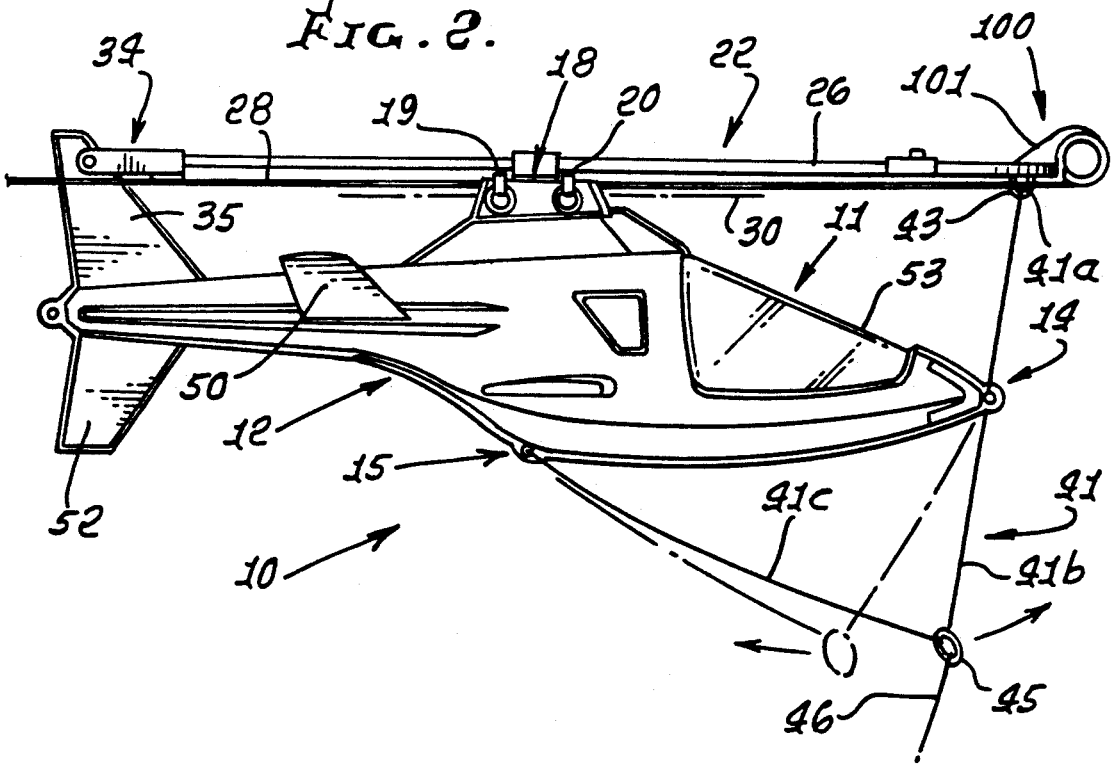
FIG. 2 is a side elevation of the FIG. 1 kite.
Figure 3:
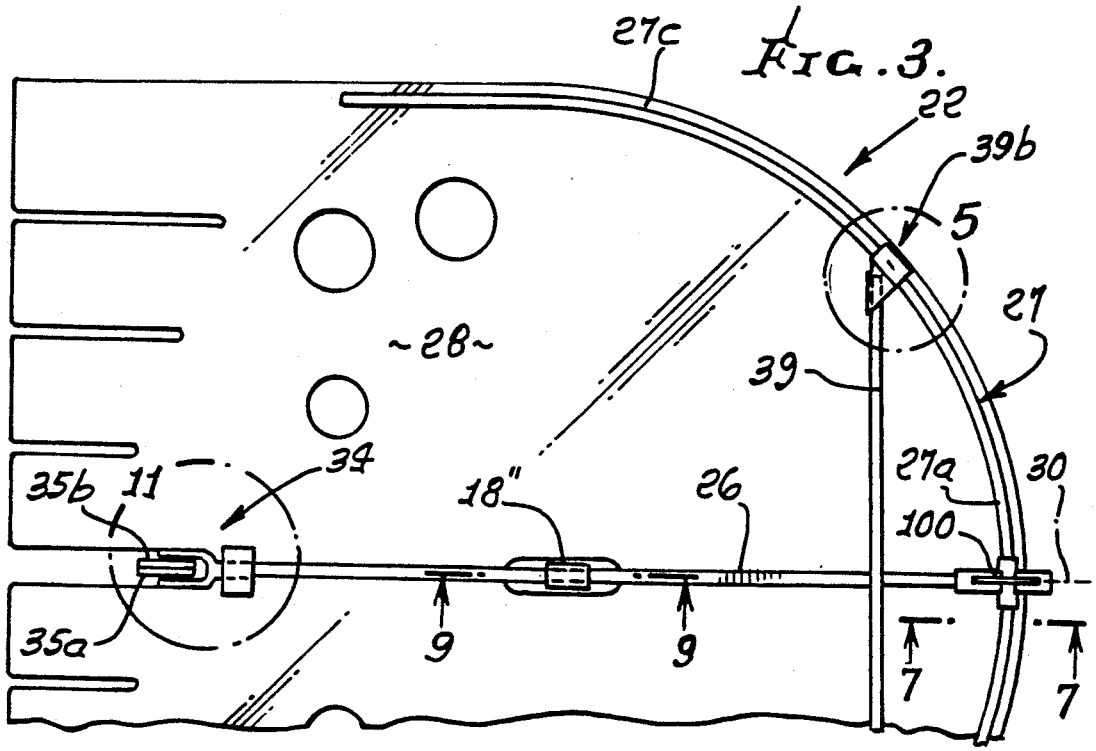
FIG. 3 is a top plan view, partly in section, of the FIG. 1 kite.
Figure 5:
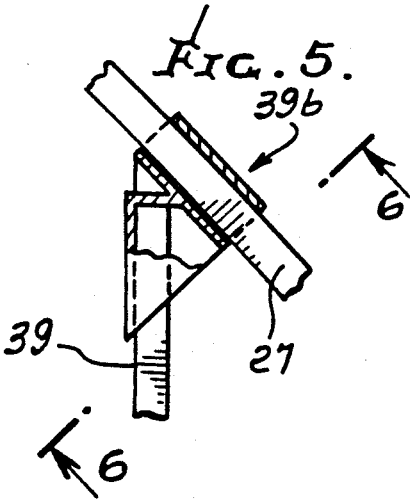
FIG. 5 is an enlarged view of a junction of parts taken on lines 5—5 of FIG. 3.
Figure 7:
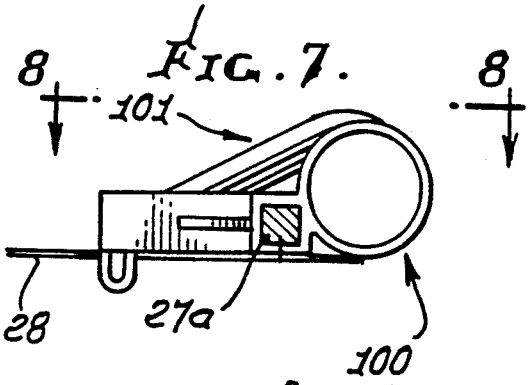
FIG. 7 is an enlarged section taken on lines 7—7 of FIG. 3.
Figure 6:
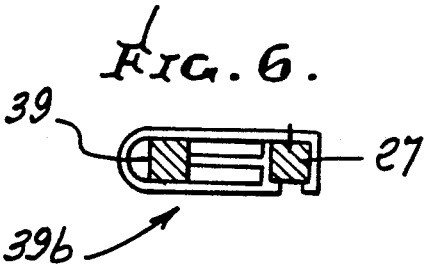
FIG. 6 is a section taken on lines 6—6 of FIG. 5.
Figure 8:
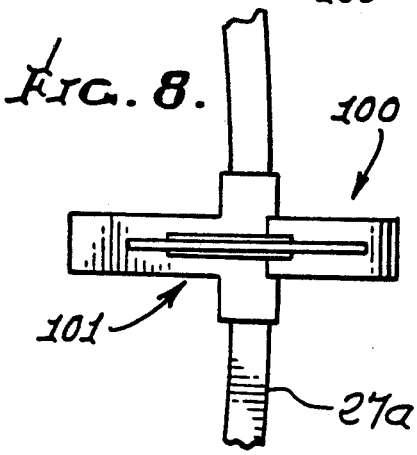
FIG. 8 is an elevation taken on lines 8—8 of FIG. 7.
Figure 11:
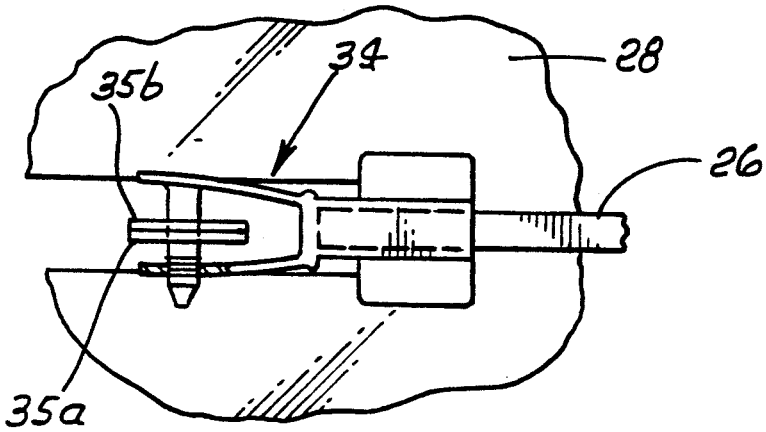
FIG. 11 is an enlarged view of the structure designated in circle 11 of FIG. 3.
Figure 12:
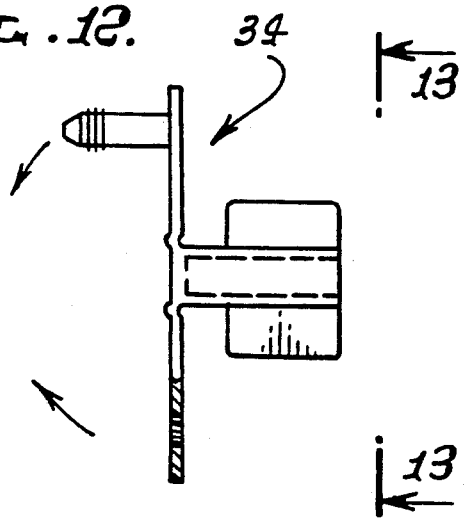
FIG. 12 is a side view of a trailing edge fitting.

Short left and right wings 50 and 51 may be provided on the fuselage sections, generally rearwardly of the location 15, as well as rearwardly of the kite retainer portion 18, as is clear from FIG. 2. Those wings have upward dihedral and aid flight stability and stunt recovery. A lower, upright fin 52 may also be provided as shown. A flexible, adhesive band 53 is attached over forward wind shield portions 54 and 55 of the fuselage sections, allowing those sections to pivot relatively apart in clam-shell manner, as in response to a nose impact of the fuselage with the ground, to prevent destruction or serious damage to the fuselage. Such pivoting is schematically shown in FIGS. 14 and 15.

FIGS. 9, 10, 11, 12, and 13 show details of various advantageous connections at the locations indicated.

A heavy-duty, upright ring 100 at the forward end of spar 26 acts as a shock absorber if impact occurs. See also structure 101 attached to 100, and passing 27a. Structure 101 may also provide pivotal attachment of spar 26 forward end.

The fuselage may consist of vinyl plastic material, or other flexible plastic material, and the sections may be sealed together if desired. The spar may also consist of plastic material or wood.

An important function of the panel or armature 13 is to reduce stress on the fuselage, and divert such stress from the kite through the armature to the bridle line. This keeps the thin walled fuselage from distortion when flying stress is present.

I claim:

1. In a toy aircraft, the combination comprising a) structure, including a forwardly elongated fuselage, having a nose portion, including left and right elongated sections, and means holding said sections in assembled relation, b) said structure having a retainer portion projecting upwardly and above said sections, c) and a forwardly and rearwardly elongated kite extending above said fuselage and attached to said retainer portion, d) the kite including a forwardly extending first spar having a forwardly extending axis, there being a pivot on said retainer portion and supporting the spar to pivot about said axis, whereby the kite may pivot about said spar axis, e) and wherein the fuselage has a nose portion and including a bridle line attached to said kite proximate forward extent of said spar and extending to a connection on said fuselage nose portion.

2. The combination of claim 1 wherein said kite extends generally horizontally relative to the fuselage, above said retainer portion, and said fuselage.

3. The combination of claim 1 wherein said retainer portion is located generally midway along the elongated length of the fuselage.

4. The combination of claim 1 wherein the bridle line also has attachment to said structure at a lower attachment location generally below the fuselage, and retainer means slidable on said bridle line for retaining the end of an elongated tether.

5. The combination of claim 1 wherein said first spar includes a forwardly and rearwardly elongated center spar having first pivotal attachment to said retainer portion above a mid-portion of the fuselage, and also having second pivotal attachment to a rearward portion of the fuselage.

6. In a toy aircraft, the combination comprising a) structure, including a forwardly elongated fuselage, including left and right elongated sections, and means holding said sections in assembled relation, b) said structure having a retainer portion projecting upwardly and above said sections, c) and a forwardly and rearwardly elongated kite extending above said fuselage and attached to said retainer portion, d) and including forward and rearward transverse openings through said retainer portion defined by parts of said sections, and strips extending through those openings and attached to said section parts.

7. The combination of claim 6 wherein said first spar extends longitudinally forwardly, and the kite includes a second spar which is U-shaped forwardly of said first spar and which includes legs that extend rearwardly at left and right lateral sides of the first spar.

8. The combination of claim 7 wherein the kite second spar left and right legs have free rear terminals adapted to flex upwardly and downwardly, and the kite including thin sheet material attached to said spars.

9. In a toy aircraft, the combination comprising a) structure, including a forwardly elongated fuselage, including left and right elongated sections, and means holding said sections in assembled relation, b) said structure having a retainer portion projecting upwardly and above said sections, c) and a forwardly and rearwardly elongated kite extending above said fuselage and attached to said retainer d) said means including an upright reinforcement panel which extends forwardly and rearwardly, between said sections, said sections having left and right complementary shell configuration and said panel retained therebetween.

10. In a toy aircraft, the combination comprising a) structure, including a forwardly elongated fuselage, including left and right elongated sections, and means holding said sections in assembled relation, b) said structure having a retainer portion projecting upwardly and above said sections, c) and a forwardly and rearwardly elongated kite extending above said fuselage and attached to said retainer, d) the kite including a forwardly and rearwardly elongated center spar having first pivotal attachment to said retainer portion above a mid-portion of the fuselage, and also having second pivotal attachment to a rearward portion of the fuselage, e) the center spar having a forward end pivotably supported by the kite, f) and wherein said second pivotal attachment includes a tail fin on the fuselage.

11. In a toy aircraft, the combination comprising a) structure, including a forwardly elongated fuselage, including left and right elongated sections, and means holding said sections in assembled relation, b) said structure having a retainer portion projecting upwardly and above said sections, c) and a forwardly and rearwardly elongated kite extending above said fuselage and attached to said retainer portion, d) and wherein the fuselage sections have forward portions, and including a flexible band adhesively attached to said forward portions allowing clamshell pivoting of said sections into spread-apart relation upon impact of said fuselage with the ground at the end of flight.

12. The combination of claim 11 wherein said section forward portion together define a fuselage wind shield.

* * * * *